United States Patent [19]

Sako

[11] Patent Number: 4,635,020

[45] Date of Patent: Jan. 6, 1987

[54] THERMAL-TYPE OVER LOAD RELAY

[75] Inventor: Yuji Sako, Aichi, Japan

[73] Assignee: Mitsubishi Denki Kabushiki Kaisha, Tokyo, Japan

[21] Appl. No.: 741,920

[22] Filed: Jun. 6, 1985

[30] Foreign Application Priority Data

| | | | |
|---|---|---|---|
| Jun. 6, 1984 | [JP] | Japan | 59-82883[U] |
| Jun. 6, 1984 | [JP] | Japan | 59-82884[U] |
| Jun. 6, 1984 | [JP] | Japan | 59-82885[U] |
| Nov. 5, 1984 | [JP] | Japan | 59-166396[U] |

[51] Int. Cl.[4] ..... H01H 61/00; H01H 71/16

[52] U.S. Cl. ..... 337/49; 337/42; 337/56

[58] Field of Search ..... 337/49, 56, 41, 42, 337/43, 44, 45, 46, 48, 53

[56] References Cited

U.S. PATENT DOCUMENTS 3,638,158 1/1972 Thorne ..... 337/49

*Primary Examiner*—Harold Broome

*Attorney, Agent, or Firm*—Sughrue, Mion, Zinn, Macpeak, and Seas

[57] ABSTRACT

A thermal-type over load relay having an improved contact operating mechanism whereby testing of the operation of the relay is made easy, malfunctions due to mechanical shock or the like are substantially eliminated, and the overall size of the relay is reduced. A thermal element is provided for opening normally closed contacts of the relay in response to heat produced by a heater through which a main circuit current flows. An operating rod is provided for closing the normally open contacts in response to the operation of a normally closed contact mechanism when the normally closed contacts are opened by the operation of the thermal element. The operating rod may be operated from the exterior of the housing of the relay for testing purposes.

11 Claims, 9 Drawing Figures

THERMAL-TYPE OVER LOAD RELAY

BACKGROUND OF THE INVENTION

The present invention relates to a thermal-type over load relay having a contact operating mechanism, and particularly to an improvement of such a contact operating mechanism.

Hitherto, a thermal-type over load relay has been used for the purpose of protecting a three-phase induction motor from burning out due to overload. There have been known thermal-type over load relays of a type having a contact operating mechanism composed of a normally closed contact, a normally open contact, and an operating rod for operating the normally open contact. However, such a contact operating mechanism is bulky in size and it is not possible to manually test its operation easily. Moreover, malfuntions of the contacts due to externally applied mechanical shocks frequent.

SUMMARY OF THE INVENTION

Accordingly, a primary object of the present invention is to overcome the disadvantages of the conventional thermal-type over load relay, and specifically to provide a thermal-type over load relay in which a contact operating mechanism is made small in size, testing of the operation of the relay is made easy, and in which malfunctions due to mechanical shock and the like are substantially eliminated.

Achieving the above and other objects, the present invention provides a thermal-type over load relay having a thermal element for opening the normally closed contact by heat produced by a heater through which a main circuit current flows, and an operating rod for closing the normally open contact in connection with a normally closed contact mechanism when the normally closed contact is opened by the operation of the thermal element, whereby it is possible to operate the operating rod from the exterior of the housing of the relay.

DESCRIPTION OF THE PREFERRED EMBODIMENTS

Figure 1:
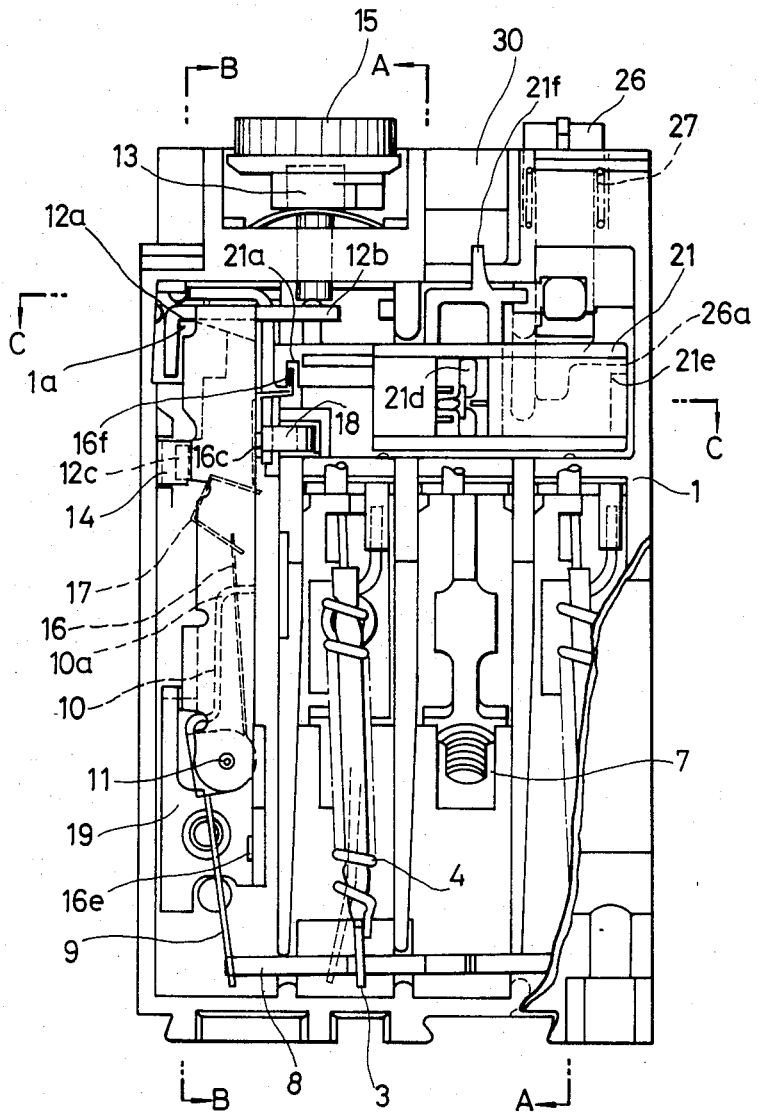
FIG. 1 is a partially cut-away front view of a thermal-type over load relay of the invention in which a cover is removed.
Figure 2:
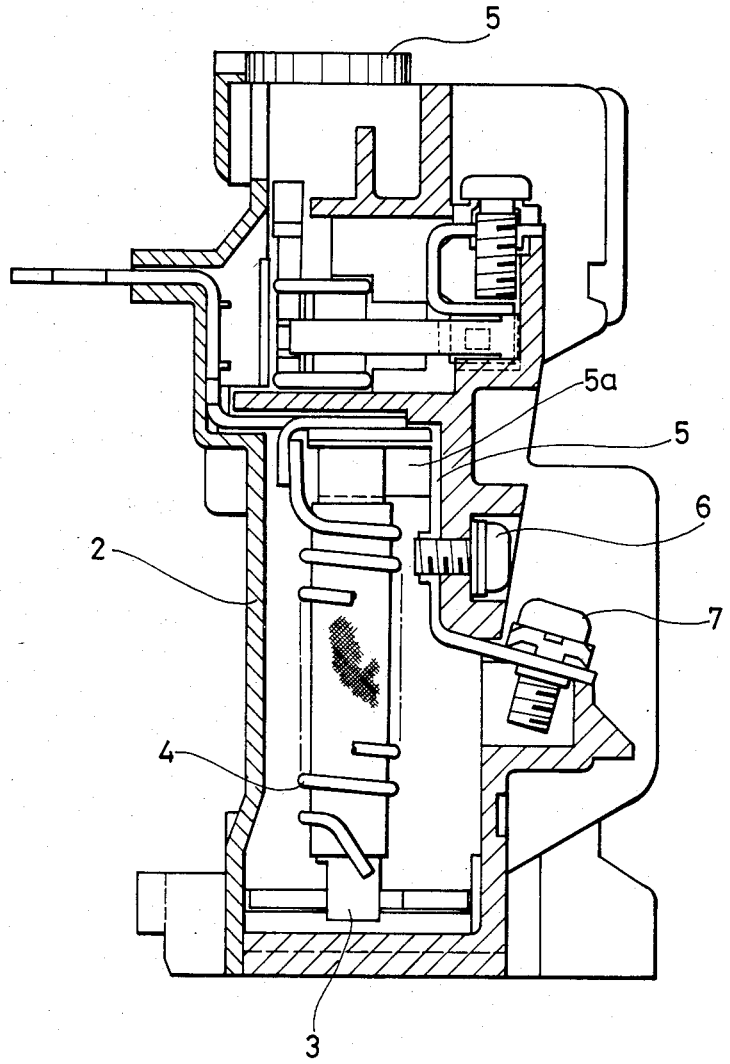
FIG. 2 is a sectional view taken along a line A—A in FIG. 1.
Figure 3:
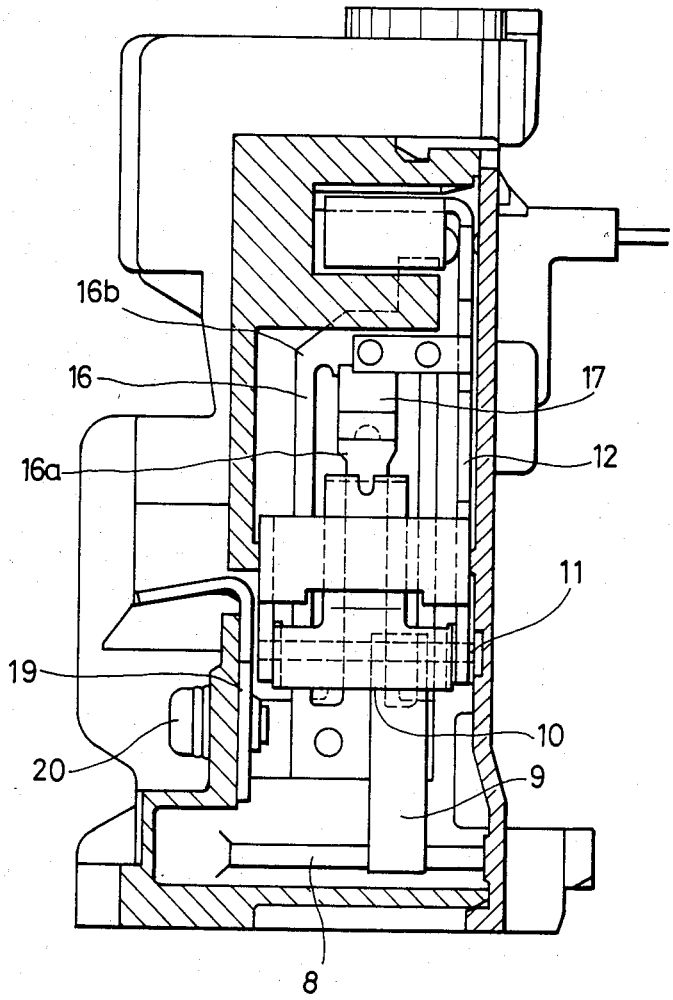
FIG. 3 is a sectional view taken along a line B—B in FIG. 1.

Referring to FIGS. 1 to 7, a first preferred embodiment of a thermal-type over load relay of the present invention will be described. In FIG. 1, reference numeral 1 denotes a housing made of a plastic material; 2, a cover made of a plastic material; 3, a bimetallic strip, which bends as shown by dotted lines in FIG. 1 upon being heated by a heater through which a main circuit current flows; and 5, a fixed terminal, a tongue portion 5*a* of which is fixed to one end of the bimetallic strip 3. The fixed terminal 5 is mounted on the housing 1 by a fastening screw 6. A terminal screw 7 is provided at the outward end of the fixed terminal 5 for making connection to an external (main) circuit. One each of the bimetallic strip 3, fixed terminal 5, fastening screw 6, terminal screw 7, etc., are provided for each of the three phases of the power source.

Reference numeral 8 denotes a shifter for transmitting movement of the bimetallic strip upon its deformation due to heating. The shifter 8 is connected to the end portions of each of the bimetallic strips 3, and one end of the shifter is connected to the lower end portion of a temperature compensating bimetallic strip 9. Reference numeral 10 denotes an operating lever to which the upper portion of the temperature compensating bimetallic strip is fixed. The operating lever 10 is rotatably mounted on a shaft 11. The two ends of the shaft 11 are supported by a lever support 12. The lever support 12 has an L-shaped inner portion 12*a* fixed to an edge portion 1*a* of the housing 1. The lever support 12 further has a first tongue portion 12*b* engaging an adjusting screw 13, and a second tongue portion 12*c* to which a spring force is applied in the leftward direction in FIG. 1 by a plate spring 14. When an adjusting knob 15, mounted on the upper portion of the adjusting screw 13, is rotated, the lever support 12 is rotated around the edge portion 1*a* in FIG. 1, and thus, in dependence on the direction of rotation of the adjusting screw 13, the shaft 11 is moved to the left or right in FIG. 1, thereby adjusting the operating current of the relay.

Figure 5:
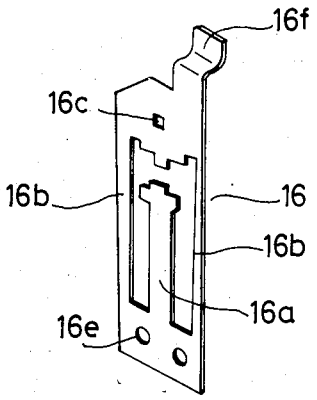
FIG. 5 is a perspective view showing a movable contact.
Figure 6:
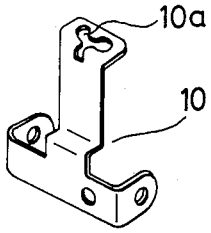
FIG. 6 is a perspective view showing an actuating lever.

Reference numeral 16 denotes a movable contact made of a thin metal plate having a high resiliency and conductivity. As shown in FIG. 5, the movable contact 16 has an inner beam portion 16*a* and an outer beam portion 16*b*. A U-shaped metal plate spring 17 is resiliently mounted between the end point of the inner beam portion 16*a* and the outer beam portion 16*b*. The contact portion 16*c* of the movable contact 16 is disposed opposite a normally closed fixed terminal 18 thereby to form a normally closed contact. The lower end portion 16*e* of the movable contact 16 is fixed to a normally closed movable side terminal 19. The normally closed movable side terminal 19 is fixed to the housing 1 by a fastening screw 20. The inner beam portion 16*a* of the movable contact 16 is inserted into a T-shaped hole 10*a* at the end portion of the operating lever 10, as shown in FIG. 6. The upper end portion 16*f* of the movable contact 16 is engaged with a groove 21*a* formed at the left end portion of the operating rod 21.

The operating rod 21 is guided by the housing 1 so as to be movable horizontally leftwardly and rightwardly in FIG. 1.

Reference numerals 22 and 23 denote normally open terminals; 24, a normally open fixed contact; and 25, a normally open movable contact. The contacts 24 and 25 are resilient and are composed of a conductive thin plate having a U shape. The contacts 24 and 25 are arranged so as to make electrical contact with the normally open contact terminals 22 and 23 due to the resilient force of the contacts 22 and 23. The end portion of the normally open movable contact 25 is inserted into a hole 21*d* having a T shape so as to contact projections 21*b* and 21*c* of the operating rod 21.

Reference numeral 26 indicates a reset rod mounted on the housing 1 in such a manner as to be movable in the upward and downward directions in FIG. 1. The reset rod 26 is normally urged in the upward direction by a spring 27, and it is stopped at the contact point. Further, a slanting surface 26*a* located at the lower portion of the reset rod 26 is disposed opposite to a vertically angled portion 21*e* of the operating rod 21 to push against the portion 21*e*. Reference numeral 30 denotes a hole formed in the housing through which passes an external projection 21*f* of the operating rod 21.

The operation of the thermal-type over load relay thus constructed will be explained hereinafter. In FIG. 1, the bimetallic strip 3 is assumed to be bent as shown by dotted lines due to heat produced by the current flowing into the main circuit, i.e., the heater 4. That is, when the motor (not shown) to which driving current is supplied through the thermal-type over load relay reaches an overload condition, the resulting increase of the main circuit current causes the bimetallic strip 3 to bend to the position indicated by dotted lines in FIG. 1, thereby pushing the shifter 8 in the leftward direction in FIG. 1. By this movement, the connected assembly composed of the temperature compensating bimetallic strip 9 and the operating lever 10 rotates around the shaft 11 by being pushed by the shifter 8 in the clockwise direction, whereupon the connected assembly contacts the periphery of the T-shaped hole 10*a* at the end of the operating lever 10 and the inner beam portion 16*a* of the movable contact 16 is moved in the rightward direction. Due to the movement of the inner beam portion 16*a*, when the movable contact 16 passes a dead center position at which the spring force of the U-shaped plate spring 17 is balanced by the force tending to move the movable contact 16 towards its initial position, the outer beam portion 16*b* and the inner beam portion 16*a* snap in the leftward and rightward directions in FIG. 1, respectively. Therefore, the normally closed contact is opened.

Figure 4:
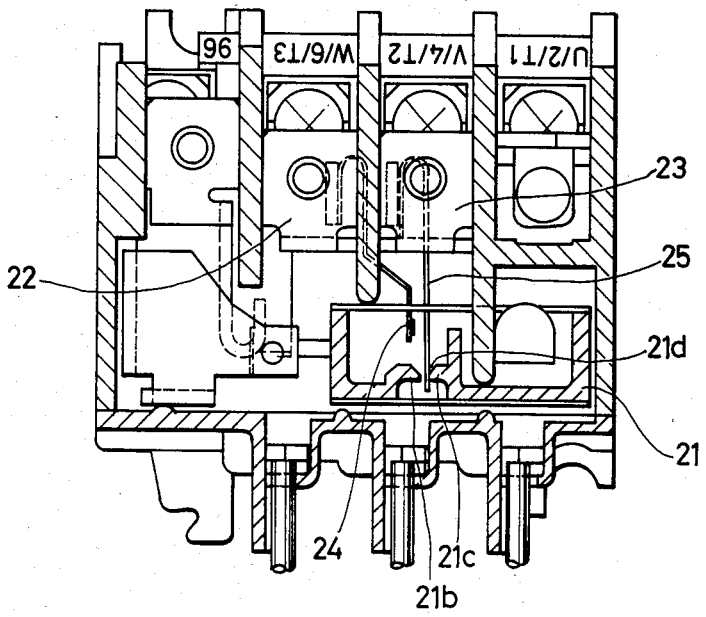
FIG. 4 is a sectional view taken along a line C—C in FIG. 1.

Then, the operating rod 21 is pulled at the end portion 16*f* to thereby be moved leftwardly in FIGS. 1 and 4, and the normally open movable contact 25 is moved in the leftward direction by the projection 21*c*. Therefore, the normally open movable contact 25 makes electrical connection with the normally open fixed contact 24, thereby making the normally open contact closed.

By connecting the normally closed contact in series with the coil circuit of an electromagnetic contactor (not shown) used for switching the main circuit current, the main circuit is protected from overload or the like. Further, if there is provided an alarm buzzer (not shown), alarm light (not shown), or the like connected in series with the normally open contact, the overload state can be indicated to the operator.

In order to return the bimetallic strip 3, normally open contact, and the normally closed contact to their initial states after the main circuit current has been interrupted, the reset rod 26 is manually depressed downwardly in FIG. 1. By this movement of the reset rod 26, the slanted surface 26*a* of the reset rod 26 pushes the angled portion 21*e* of the operating rod 21 in the rightward direction, whereupon the operating rod and the outer beam portion 16*b* of the movable contact 16 are moved rightwardly, as a result of which the movable contact 16 passes the dead center position and snaps back to the state shown in FIG. 1.

In the case where no current is being applied to the main circuit and it is desired to test the circuit by actuating the contact of the thermal-type over load relay, this may be done by manually moving the exernal projection 21*f* of the operating rod 21 in the leftward direction, thereby turning the movable contact 16.

It is to be noted that, with the construction described above, the ON and OFF states of the relay can be discriminated externally by the position of the external projection 21*f*.

In FIGS. 1 to 4, the normally open movable contact 25 is inserted into the T-shaped hole 21*d* and contacts the projection 21*c* in the operated condition. The contacts 24 and 25 are opened by being pushed by the projection 21*b*. With the T-shaped hole 21*d* opening in the direction shown in FIG. 1, the normally open fixed contact 24 can be seen through the hole 21*d*, and thus it is easy to check the gap between contacts when the cover 2 is removed.

As mentioned above, according to the above embodiment, the space occupied by the contact operating mechanism has an L shape, as shown in FIG. 1, which makes it possible to reduce the external width dimension of the over load relay. Further, since the external projection 21*f* of the operating rod 21 is mounted on the upper portion of the relay, the projection 21*f* can be easily operated manually and the ON-OFF condition of the over load relay can be easily discriminated in accordance with the height of the external projection.

Furthermore, the operational direction of the normally closed and open contacts, composed of the contact portion 16*c*, the normally closed fixed terminal 18, the normally open fixed contact 24, and the normally open movable contact 25, is in the direction parallel to a mounting base surface (the lower surface of the relay in FIG. 1), and therefore there is an advantage that malfunctions of the contacts due to vibration or mechanical shock transmitted through the mounting base surface in the vertical direction are significantly reduced. Still further, since the reset operation is effected by pushing the operating rod 21 to move the normally open contact via the reset rod 26, even if movement of the reset rod 26 is restricted in its depressed state, the normally closed contact will still be opened upon an overload occurring, thereby ensuring safety.

The thermal-type over load relay is installed in a control circuit for controlling the motor. Sometimes it is a desirable or necessary precaution to test whether or not the control circuit is operating normally by manually tripping the over load relay. Such a testing operation is generally effected by manually operating the contact mechanism without supplying electric power to the thermal element composed of the bimetallic strips and heater of the relay.

Figure 7:
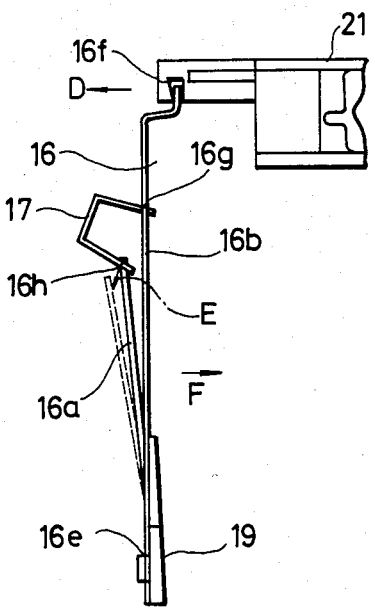
FIG. 7 is an enlarged side view mainly showing the movable contact and an operating rod.

Referring to FIG. 7, such manual tripping will be described further in detail. In FIG. 7, manual tripping is effected by pushing the operating rod 21 in the direction shown by the arrow D. In accordance with the movement of the operating rod 21 in the D direction, the outer beam portion 16*b* is also moved in the D direction since the upper portion 16*f* of the movable contact 16 is interlocked with the operating rod 21. When the joining point 16*g* between the outer beam portion 16*b* and the plate spring 17 is moved (rather than the joining point 16*h* between the inner beam portion 16*a* and the plate spring 17), namely, when the movable contact 16 passes the dead center position, the direction of the pressing force due to the plate spring 17 is changed and the inner beam portion 16*a* is rapidly moved in the rightward direction while the outer beam portion 16*b* is rapidly moved in the leftward direction, thereby completing the operation of manual tripping.

The positional interrelationship between the joining points 16*g* and 16*h*, namely, the case where the movement exceeds the dead center point, will be further explained hereinafter.

When the outer beam portion 16*b* is moved in the leftward direction and the joining point 16*g* is also moved in the leftward direction, the plate spring 17 is compressed and thus applies a force in the E direction to the joining point 16*h*, and the inner beam portion 16*a* of the movable contact 16 is deformed by the force in the E direction, as shown by the dotted line in FIG. 7. That is, to complete the manual tripping operation, it is necessary to additionally push the operating rod 21 in the D direction through a distance equal to the amount of deformation of the inner beam portion 16*a* of the movable contact 16.

When the inner beam portion 16*a* is moved due to deformation of the bimetallic strip 3, the inner beam portion 16*a* will be deformed in the F direction indicated in FIG. 7. Because the force deforming the inner beam portion 16*a* in the direction F acts as a resistance force against the deformation of the bimetallic strip, it is desirable to reduce the deforming force. To this end, the inner beam poriton 16*a* is made elongated by fixing the movable contact 16 on the normally closed movable terminal 19 at the lower end portion 16*e*, as shown in FIG. 7, thereby making the deforming force relatively weak. On the other hand, such an approach for reducing the deforming force means that the amount of deformation of the inner beam portion 16*a* upon manual tripping, as shown by dotted lines in FIG. 7, is large. Also, in the above-described relay, the amount of movement of the operating rod required for the manual tripping operation is relatively great due to the deformation of the inner beam portion 16*a* of the movable contact 16. Further, the amount of force required for manual tripping can vary greatly with variations of the amount of deformation of the inner beam portion 16*a*.

Figure 8:
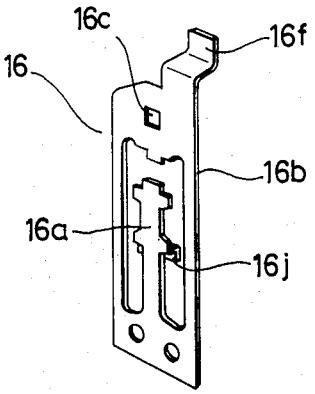
FIG. 8 is an enlarged perspective view of a modified embodiment of the movable contact.
Figure 9:
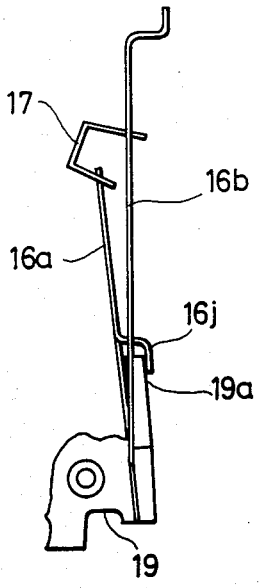
FIG. 9 is an enlarged side view of a modified embodiment of the movable contact mounted on a normally open movable terminal.

Referring to FIGS. 8 and 9, another embodiment of the movable contact 16 will be described in which the problem mentioned above is eliminated. As shown in FIG. 8, there is provided a bent portion 16*j* at the central portion of the inner beam portion 16*a* of the movable contact 16, formed using pressing operation or the like. The bent portion 16*j* is enlarged with the elongated portion 19*a* of the normally closed movable terminal 19, as shown in FIG. 9.

With this arrangement, the amount of deformation of the inner beam portion 16*a* of the movable contact 16 (as shown in FIG. 7) is reduced so that the amount of movement of the operating rod 21 required for manual tripping is also reduced.

By using the arrangement as shown in FIGS. 8 and 9, the amount of deformation of the inner beam portion 16*a* of the movable contact upon manual tripping is reduced so that the manual tripping operation is made smooth and sure. Further, the amount of movement of the operating rod 21 required for manual tripping is reduced so that the dimension of the over load relay in the horizontal direction in FIG. 1 can be reduced. It is another advantage of the present invention that the above-mentioned advantages are achieved without increasing the resistance force acting against the deformation of the bimetallic strip.

Although the present invention has been described with reference to preferred embodiments, it is understood that the invention can be changed in details of construction, and the combination and arrangement of parts may be modified without departing from the spirit and the scope of the present invention as hereinafter claimed.

I claim:

1. A thermal-type over load relay comprising:

a normally closed contact mechanism having normally closed contacts;

a normally open contact mechanism having normally open contacts;

a thermal element atuated by heat produced by a heater through which a main circuit current flows for opening said normally closed contacts;

a movably mounted operating rod for opening said normally open contacts of said normally open contact mechanism and for closing normally open contacts in response to operation of said normally closed contact mechanism when said normally closed contacts are opened by actuation of said thermal element; and a housing enclosing said operating rod, said thermal element, said normally closed contact mechanism, and said normally open contact mechanism;

said operating rod having an operating portion projecting externally of said housing for closing said normally open contacts by manually moving said operating rod externally of said housing.

2. The thermal-type over load relay according to claim 1, wherein said normally open contact mechanism comprises a normally open movable contact and a normally open fixed contact, and wherein one end of said normally open movable contact is inserted into a T-shaped hole in said operating rod.

3. The thermal-type eddy current relay according to claim 1, wherein said operating rod has an operating portion projecting from an upper surface of said housing.

4. The thermal-type over load relay according to claim 1, wherein said operating rod has a groove formed in an end poriton thereof, an end portion of said normally closed contact mechanism being disposed in said groove.

5. The thermal-type over load relay according to claim 1, wherein said normally closed contact mechanism comprises: a movable contact side terminal fixed to said housing, a fixed contact side terminal fixed to said housing and a movable contact element made of a resilient thin plate material and disposed between said fixed contact side terminal and said movable contact side terminal, said movable contact element moving in response to actuation of said thermal element and being fixed to said movable thermal contact side terminal.

6. The thermal-type over load relay according to claim 1, wherein said normally closed contact mechanism comprises: a movable contact side terminal moving in response to actuation of said thermal element, a fixed contact side terminal fixed to said housing, and a movable contact made of a resilient thin plate material and disposed between said fixed contact side terminal and said movable contact side terminal, said movable contact being fixed to said movable contact side terminal, said movable contact having an inner beam portion and an outer beam portion, a spring disposed between said inner beam portion and said outer beam portion, and a reverse mechanism for reversing said inner beam portion or said outer beam portion when said thermal element is actuated, said normally closed contacts being opened when said inner beam portion or said outer beam portion is reversed by said reverse mechanism.

7. The thermal-type over load relay according to claim 6, wherein said operating rod is mounted to be movable in a direction parallel to a direction of said reverse operation of said inner beam portion or said outer beam portion of said movable contact, and is moved in accordance with a reverse operation of said movable contact, thereby opening or closing said normally open contacts of said normally open contact mechanism through said operating rod.

8. The thermal-type over load relay according to claim 6, wherein said normally closed contact mechanism comprises means for restricting movement of said inner beam portion of said movable contact in a direction opposite to the direction in which said movable contact moves when actuated by said thermal element.

9. The thermal-type over load relay according to claim 1, wherein said normally open contacts are opened by said operating rod in response to operation of said normally closed contact mechanism when said normally closed contacts are closed.

10. A thermal-type over load relay comprising:

a normally closed contact mechanism having normally closed contacts;

a normally open contact mechanism having normally open contacts;

a thermal element actuated by heat from a heater through which a main circuit current flows for opening said normally closed contacts;

an operating rod movably mounted to open said normally open contacts of said normally open contact mechanism and for closing said normally open contacts in response to operation of said normally closed contact mechanism when said normally closed contacts are opened by actuation of said thermal element;

a housing enclosing said operating rod, said thermal element, said normally closed contact mechanism, and said normally open contact mechanism;

said operating rod having an operating portion projecting externally of said housing for closing said normally open contacts by manually moving said operating rod externally of said housing; and a reset rod supported on said housing in such a manner as to be movable in a direction substantially perpendicular to a direction of movement of said operating rod for returning said operating rod to open said normally open contacts.

11. The thermal-type over load relay according to claim 10, wherein said normally closed contacts of said normally closed contact mechanism are closed by movement of said operating rod in response to movement of said reset rod, and said normally open contacts are opened by movement of said operating rod in response to operation of said normally closed contact mechanism when said normally closed contacts are closed.

* * * * *